US011603640B2

(12) United States Patent
Plante et al.

(10) Patent No.: US 11,603,640 B2
(45) Date of Patent: Mar. 14, 2023

(54) DEPLOYABLE COFFERDAM WEB-SUPPORTING FRAME ASSEMBLY FOR A COFFERDAM SYSTEM, COFFERDAM SYSTEM COMPRISING THE SAME AND CORRESPONDING METHOD FOR DELIMITING AN ENCLOSURE WITHIN A BODY OF WATER

(71) Applicant: Aquapera Industries Inc., Prévost (CA)

(72) Inventors: Louis-Philippe Plante, Prévost (CA); Nicolas Rivest Auger, Prévost (CA)

(73) Assignee: Aquapera Industries Inc., Prévost (CA)

( * ) Notice: Subject to any disclaimer, the term of this patent is extended or adjusted under 35 U.S.C. 154(b) by 0 days.

(21) Appl. No.: 17/393,945

(22) Filed: Aug. 4, 2021

(65) Prior Publication Data

US 2022/0042270 A1 Feb. 10, 2022

Related U.S. Application Data

(60) Provisional application No. 63/060,755, filed on Aug. 4, 2020.

(51) Int. Cl.
*E02D 19/04* (2006.01)

(52) U.S. Cl.
CPC ..... *E02D 19/04* (2013.01)

(58) Field of Classification Search
CPC ..... E02D 19/02; E02D 19/04; E02B 3/106; E02B 7/20; B65D 90/047
See application file for complete search history.

(56) References Cited

U.S. PATENT DOCUMENTS 4,136,995 A * 1/1979 Fish ..... E02B 7/005 210/162
4,511,286 A * 4/1985 Hardacre ..... E02B 3/106 405/91
4,692,060 A * 9/1987 Jackson, III ..... E02B 3/108 405/91
4,921,373 A * 5/1990 Coffey ..... E02B 7/16 405/91

(Continued)

*Primary Examiner* — Benjamin F Fiorello
(74) *Attorney, Agent, or Firm* — Kolitch Romano Dascenzo Gates LLC

(57) ABSTRACT

A deployable cofferdam web-supporting frame assembly for a cofferdam system configured to be installed within a body of water to at least partially delimit therein an enclosure. The deployable cofferdam web-supporting frame assembly comprises first and second frame-supporting structures comprising first and second apexes and first and second groups of longitudinally extending frame-supporting legs each having a waterbed-engaging end, the first and second frame-supporting structure being configurable into a usage configuration wherein the frame-supporting legs are connected to each other with the waterbed-engaging ends thereof being spaced apart from one another, and a storage configuration wherein the frame-supporting legs are substantially parallel to each other; and a connecting assembly connecting the first and second apexes to each other. It also concerns a cofferdam system comprising the same and a corresponding method for delimiting an enclosure within a body of water.

20 Claims, 12 Drawing Sheets

(56) References Cited

U.S. PATENT DOCUMENTS

| | | | | |
|---|---|---|---|---|
| 6,079,904 | A * | 6/2000 | Trisl | E02B 3/106 405/116 |
| 6,676,333 | B2 * | 1/2004 | Wiseman | E02B 3/106 405/102 |
| 8,434,967 | B2 * | 5/2013 | Nero | E06B 3/984 405/114 |
| 8,662,335 | B2 * | 3/2014 | Van Romer | B65D 88/22 220/9.1 |
| 9,574,314 | B2 * | 2/2017 | Sápi | E02B 3/108 |
| 2013/0020331 | A1 * | 1/2013 | Davis | E02B 3/10 220/565 |
| 2014/0308078 | A1 * | 10/2014 | Mulvihill | E02B 3/106 405/16 |

* cited by examiner

DEPLOYABLE COFFERDAM WEB-SUPPORTING FRAME ASSEMBLY FOR A COFFERDAM SYSTEM, COFFERDAM SYSTEM COMPRISING THE SAME AND CORRESPONDING METHOD FOR DELIMITING AN ENCLOSURE WITHIN A BODY OF WATER

RELATED APPLICATION

The present application claims priority under 35 U.S.C. § 119(e) to U.S. Provisional Patent Application No. 63/060,755, filed on Aug. 4, 2020, and entitled "COFFERDAM WEB-SUPPORTING FRAME ASSEMBLY FOR A COFFERDAM SYSTEM AND COFFERDAM SYSTEM ASSOCIATED THEREWITH", the disclosure of which being hereby incorporated by reference in its entirety.

TECHNICAL FIELD

The present disclosure relates to the field of cofferdam systems and methods of installing the same. More particularly, the present disclosure relates to a modular and/or deployable cofferdam web-supporting frame assembly for a cofferdam system, to a corresponding cofferdam system comprising the same and to a corresponding method for at least partially delimiting an enclosure within a body of water.

BACKGROUND

A cofferdam, or coffer, is an enclosure, or barrier, that is built within a body of water, a waterway or a watercourse for example, to allow water found in the enclosed area, or downstream of the barrier, to be pumped out such as to provide a substantially dry environment downstream of the coffer. Such pumping creates a dry work environment for the work to be carried out. Enclosed coffers are commonly used for construction or repair of permanent dams, oil platforms, bridge piers, etc., built within or over water.

Known cofferdam systems usually include a main frame made of a plurality of support posts that is configured so as to be anchored to the bed of the waterway or watercourse, as well as a flexible impermeable web that is secured to and that covers, at least in part, an exterior of the main frame (for instance a water-facing side thereof). Therefore, to operate the system in a waterway which is full of water, the main frame is first secured to the bed of the waterway. Second, the flexible impermeable web is draped across the waterway to cover the exterior of the main frame, or at least a lower portion thereof. When the skirt of the flexible impermeable web is resting on the bed of the waterway, pumping is provided to remove water from the downstream side of the dam, thereby establishing a pressure differential between the two surfaces of the flexible impermeable web.

That being said, there already exists on the market cofferdam systems. However, not all of these systems are simple to install. Additionally, most of them do not allow to adjust the main frame relative to the bed of the waterway. Indeed, since these frames are self-supportive, if the bed of the waterway is uneven, they cannot be used properly to provide the desired enclosed area from which water can be pumped out.

Some systems are also found to be pretty heavy, not stackable, and thus, not easy to transport. Furthermore, the frames are often manufactured/customized to meet the specifications of one site only and thus cannot be re-used according to the specifications of a different site. Some systems are usually dismantled and not re-used after the construction work is completed.

There is therefore a need for improved re-usable, portable and modular cofferdam web-supporting frame assemblies for a cofferdam system that can be easily stacked in a truck or warehouse, for example, and for an improved method of installing the same that can help in providing a proper dry environment for workers, even if the waterway or watercourse bed is uneven and cannot accommodate conventional self-supportive cofferdam web-supporting frames or cofferdam systems.

In other words, there remains a need for cofferdam web-supporting frame assemblies and cofferdam systems, which by virtue of their designs and components, would be able to overcome or at least minimize some of the above-discussed concerns.

SUMMARY

It is an object of the present disclosure to provide a cofferdam web-supporting frame assembly and a cofferdam system that overcome or mitigate one or more disadvantages of known cofferdam web-supporting frames and cofferdam systems, or at least provide useful alternatives.

According to a general aspect of the disclosure, there is provided a deployable cofferdam web-supporting frame assembly for a cofferdam system configured to be installed within a body of water to at least partially delimit an enclosure, the deployable cofferdam web-supporting frame assembly comprising: a first frame-supporting structure comprising a first apex and a first group of longitudinally extending frame-supporting legs each having a waterbed-engaging end, the first frame-supporting structure being configurable into a usage configuration wherein the frame-supporting legs are connected to each other with the waterbed-engaging ends thereof being spaced apart from one another, and a storage configuration wherein the frame-supporting legs are substantially parallel to each other; a second frame-supporting structure comprising a second apex and a second group of longitudinally extending frame-supporting legs each having a waterbed-engaging end, the second frame-supporting structure being configurable into a usage configuration wherein the frame-supporting legs are connected to each other with the waterbed-engaging ends thereof being spaced apart from one another, and a storage configuration wherein the frame-supporting legs are substantially parallel to each other; and a connecting assembly connecting the first and second apexes to each other.

According to another general aspect, there is provided a modular cofferdam web-supporting frame assembly for a cofferdam system configured to be installed within a body of water to at least partially delimit an enclosure, the modular cofferdam web-supporting frame assembly comprising: a first frame-supporting structure comprising: a first legs-retaining member; and a first group of longitudinally extending frame-supporting legs, each one of the frame-supporting legs being engaged with the first legs-retaining member and having a waterbed-engaging end, the waterbed-engaging ends of the first group of frame-supporting legs being spaced apart from one another; a second frame-supporting structure comprising: a second legs-retaining member spaced-apart from the first legs-retaining member; a second group of longitudinally extending frame-supporting legs, each one of the frame-supporting legs being engaged with the second legs-retaining member and having a waterbed-engaging end, the waterbed-engaging ends of the second group of frame-supporting legs being spaced apart from one another; and a connecting assembly connecting the first and second legs-retaining members to each other.

According to another general aspect, there is provided a cofferdam system comprising: a cofferdam web-supporting frame assembly according to the present disclosure; and a substantially flexible impermeable web secured to the cofferdam web-supporting frame assembly, the substantially flexible impermeable web covering at least partially a water-facing side of the cofferdam web-supporting frame assembly.

According to yet another general aspect of the disclosure, there is provided a method for at least partially delimiting an enclosure within a body of water, the method comprising: positioning first and second frame-supporting structures onto a waterbed of the body of water, with apexes of the first and second frame-supporting structures being spaced apart from each other; engaging a connecting assembly with the apexes of the first and second frame-supporting structures; and securing an impermeable web to a web-supporting transversal member of the connecting assembly, with a waterbed-engaging edge of the impermeable web resting on the waterbed of the body of water.

In accordance with another embodiment, there is provided a cofferdam system configured to be installed across a body of water to provide a temporary dam delimiting a perimeter or a segment of a perimeter and comprising: a plurality of cofferdam web-supporting frame assemblies configured to be spaced-apart along the perimeter or the segment of the perimeter, each one of the plurality of cofferdam web-supporting frame assemblies comprising: a first web-supporting structure comprising: a first legs-retaining member; a first group of longitudinally extending frame-supporting legs, each one of the longitudinally extending frame-supporting legs extending between a waterbed-engaging end and an upper end and having an upper portion being engageable with the first legs-retaining member, the longitudinally extending frame-supporting legs of the first group extending in a different orientation with their waterbed-engaging ends being spaced apart from one another; a second web-supporting structure spaced-apart from the first web-supporting structure and comprising: a second legs-retaining member spaced-apart from the first legs-retaining member; a second group of longitudinally extending frame-supporting legs, each one of the longitudinally extending frame-supporting legs extending between a waterbed-engaging end and an upper end and having an upper portion being engageable with the second legs-retaining member, the longitudinally extending frame-supporting legs of the second group extending in a different orientation with their waterbed-engaging ends being spaced apart from one another; and a connecting post being releasably securable to upper portions of the first and second web-supporting structures respectively; and a substantially flexible impermeable web engageable with and securable to the plurality of cofferdam web-supporting frame assemblies, the substantially flexible impermeable web being configured for covering an exterior side of the plurality of cofferdam web-supporting frame assemblies and to be positioned across the body of water; wherein the plurality of cofferdam web-supporting frame assemblies and the substantially flexible impermeable web together provide the temporary dam once water has been pumped out from a downstream side of the substantially flexible impermeable web.

In accordance with another embodiment, there is provided a cofferdam web-supporting frame assembly for a cofferdam system configured to be installed across a body of water to provide a temporary dam delimiting a perimeter or a segment of a perimeter, the cofferdam web-supporting frame assembly comprising: a first web-supporting structure comprising: a first legs-retaining member; a first group of longitudinally extending frame-supporting legs, each one of the longitudinally extending frame-supporting legs extending between a waterbed-engaging end and an upper end and having an upper portion being engageable with the first legs-retaining member, the longitudinally extending frame-supporting legs of the first group extending in a different orientation with their waterbed-engaging ends being spaced apart from one another; a second web-supporting structure spaced-apart from the first web-supporting structure and comprising: a second legs-retaining member spaced-apart from the first legs-retaining member; a second group of longitudinally extending frame-supporting legs, each one of the longitudinally extending frame-supporting legs extending between a waterbed-engaging end and an upper end and having an upper portion being engageable with the second legs-retaining member, the longitudinally extending frame-supporting legs of the second group extending in a different orientation with their waterbed-engaging ends being spaced apart from one another; and a connecting post being releasably securable to upper portions of the first and second web-supporting structures respectively.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

Figure 1:
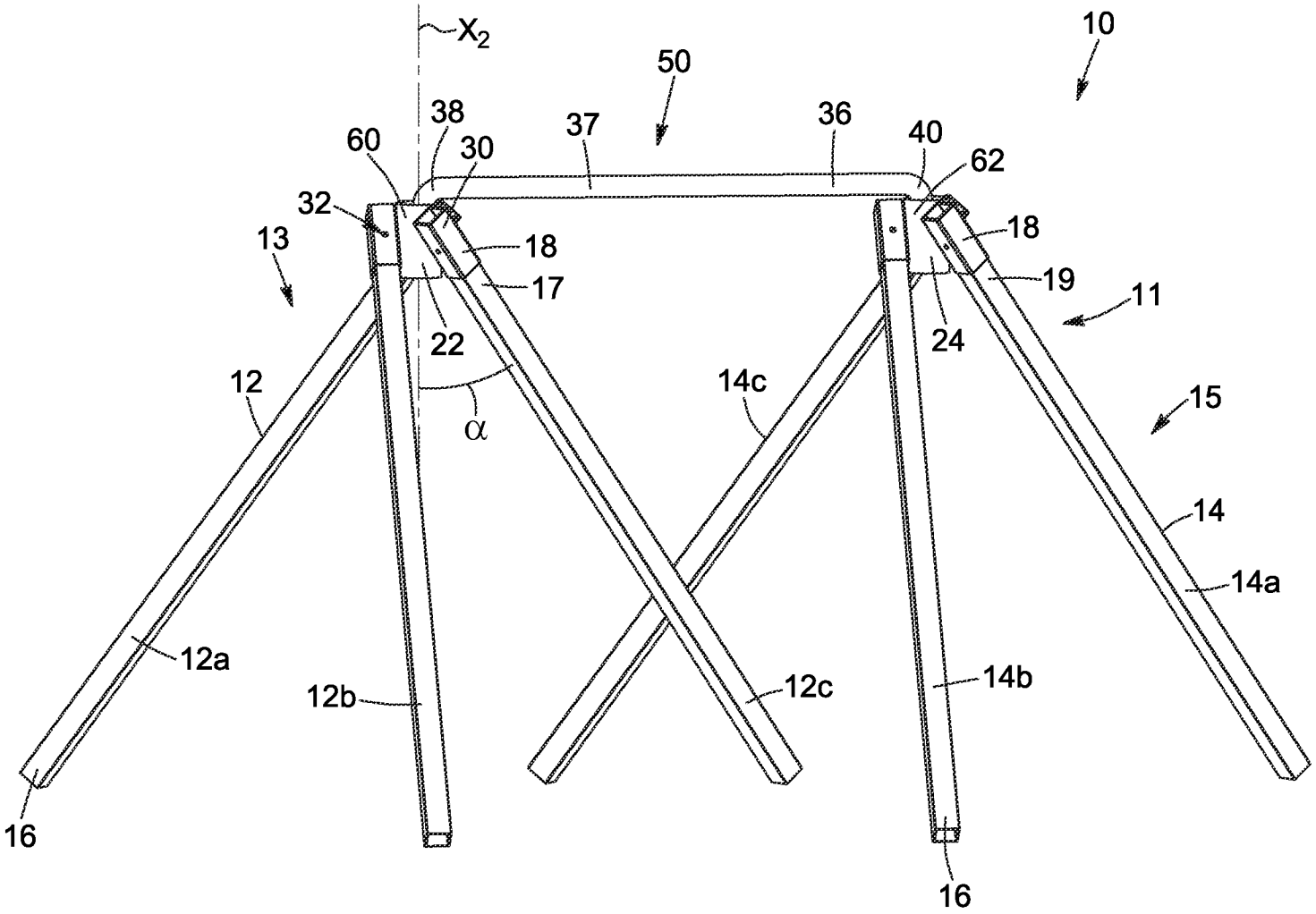
FIG. 1 is a side perspective view of a cofferdam web-supporting frame assembly in accordance with a first embodiment, the cofferdam web-supporting frame assembly comprising first and second frame-supporting structures in a usage configuration and a connecting assembly comprising a web-supporting transversal member.

In the following description, the same numerical references refer to similar elements. Furthermore, for the sake of simplicity and clarity, namely so as to not unduly burden the figures with several reference numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures or described in the present disclosure are embodiments only, given solely for exemplification purposes.

Furthermore, in the context of the present description, it will be considered that all elongated objects will have an implicit "longitudinal axis" or "centerline", such as the longitudinal axis of a shaft for example, or the centerline of a biasing device such as a coiled spring, for example, and that expressions such as "connected" and "connectable", "secured" and "securable", "engaged" and "engageable", "installed" and "installable" or "mounted" and "mountable", may be interchangeable, in that the present cofferdam web-supporting frame assembly or cofferdam system also relates to kits with corresponding components for assembling a resulting fully-assembled and fully-operational cofferdam web-supporting frame assembly or cofferdam system.

Moreover, components of the cofferdam web-supporting frame assembly, cofferdam system and/or steps of the method(s) described herein could be modified, simplified, altered, omitted and/or interchanged, without departing from the scope of the present disclosure, depending on the particular applications which the present cofferdam web-supporting frame assembly or cofferdam system are intended for, and the desired end results, as briefly exemplified herein and as also apparent to a person skilled in the art.

In addition, although the embodiments as illustrated in the accompanying drawings comprise various components, and although the embodiments of the cofferdam web-supporting frame assembly or cofferdam system and corresponding portion(s)/part(s)/component(s) as shown consist of certain geometrical configurations, as explained and illustrated herein, not all of these components and geometries are essential and thus should not be taken in their restrictive sense, i.e., should not be taken so as to limit the scope of the present disclosure. It is to be understood, as also apparent to a person skilled in the art, that other suitable components and cooperation thereinbetween, as well as other suitable geometrical configurations may be used for the present cofferdam web-supporting frame assembly, cofferdam system and corresponding portion(s)/part(s)/component(s) according to the present cofferdam web-supporting frame assembly or cofferdam system, as will be briefly explained herein and as can be easily inferred herefrom by a person skilled in the art, without departing from the scope of the present disclosure.

To provide a more concise description, some of the quantitative and qualitative expressions given herein may be qualified with the terms "about" and "substantially". It is understood that whether the terms "about" and "substantially" are used explicitly or not, every quantity or qualification given herein is meant to refer to an actual given value or qualification, and it is also meant to refer to the approximation to such given value or qualification that would reasonably be inferred based on the ordinary skill in the art, including approximations due to the experimental and/or measurement conditions for such given value.

The present disclosure describes a deployable and/or modular cofferdam web-supporting frame assembly for a cofferdam system, and a cofferdam system associated therewith, which, by virtue of their designs and components, overcome or at least minimize some of the above-discussed drawbacks. The present cofferdam system is configured to be installed across and/or within a body of water, such as a river, a canal, an estuary, a lake, a sea, an ocean, etc., to provide a temporary dam. In one scenario, the cofferdam system described herein can delimit a perimeter, or a segment of a perimeter, so that an enclosed working area located inwardly of the perimeter can be provided. In other words, the cofferdam system is configured to at least partially delimit an enclosed working area within a body of water. In another scenario, the cofferdam system can have a substantially longitudinally extending configuration (or an opened configuration) so as to be used as a barrier to protect buildings or other elements located downstream of the cofferdam system from potentially being flooded. Unless otherwise stated, the terms "upstream" and "downstream" should be understood relative to a fluid circulation flow in a body of water.

In one implementation, the cofferdam system can include a plurality of cofferdam web-supporting frame assemblies which can be at least partially spaced-apart from each other along a width of the watercourse, for example, or positioned along a perimeter, or a segment thereof. For example, the plurality of cofferdam web-supporting frame assemblies of the cofferdam system can be spaced-apart along a specific perimeter to provide the enclosed working area and to contain a structure to be repaired or restored being located inwardly of the perimeter (i.e., downstream of the cofferdam system and/or at least partially surrounded by the cofferdam system). The cofferdam system can further include a substantially flexible impermeable web which can be engageable with and securable to the plurality of cofferdam web-supporting frame assemblies. The substantially flexible impermeable web can be configured for at least partially covering a water-facing side (or exterior side, considered with respect to the enclosed area once the cofferdam system has been installed) of the plurality of cofferdam web-supporting frame assemblies, at least a lower section thereof, and to be positioned across the body of water. The plurality of cofferdam web-supporting frame assemblies and the substantially flexible impermeable web can thus together provide the temporary dam once water has been pumped out from the downstream side (or inner side, considered with respect to the enclosed area once the cofferdam system has been installed) of the substantially flexible impermeable web.

Each cofferdam web-supporting frame assembly can be releasably assembled using a plurality of components that releasably engage with one another so each cofferdam web-supporting frame assembly can be easily transported and stacked over another similar assembly, in a vehicle or warehouse, for example, when in a disassembled configuration or storage configuration.

In one implementation, as represented for instance in FIG. 1, the deployable and/or modular cofferdam web-supporting frame assembly 10 comprises a first frame-supporting structure 13 comprising a first apex 60 and a first group of longitudinally extending frame-supporting legs 12, such as legs 12*a*, 12*b*, 12*c*, each having a waterbed-engaging end 16, the first frame-supporting structure 13 being configurable into a usage configuration wherein the frame-supporting legs are connected to each other with the waterbed-engaging ends thereof being spaced apart from one another, and a storage configuration wherein the frame-supporting legs are substantially parallel to each other; a second frame-supporting structure 15 comprising a second apex 62 and a second group of longitudinally extending frame-supporting legs 14, such as legs 14*a*, 14*b*, 14*c*, each having a waterbed-engaging end 16, the second frame-supporting structure 15 being configurable into a usage configuration wherein the frame-supporting legs are connected to each other with the waterbed-engaging ends 16 thereof being spaced apart from one another, and a storage configuration wherein the frame-supporting legs are substantially parallel to each other; and a connecting assembly 50 connecting the first and second apexes 60, 62 to each other. As detailed below, the first and second frame-supporting structures each comprise a legs-retaining member 22, 24 forming at least partially respectively the first and second apexes 60, 62, with the frame-supporting legs being engaged with the corresponding legs-retaining member. For instance, the connecting assembly 50 is configured to connect the first and second legs-retaining members 22, 24 to each other.

In other words, each cofferdam web-supporting frame assembly can include a first frame-supporting structure, a second frame-supporting structure configured to be mounted in a spaced-apart configuration from the first frame-supporting structure, as well as a connecting assembly being securable to the first and second frame-supporting structures (for instance to upper portions thereof), respectively, to connect the first and second frame-supporting structures together when configured in the spaced-apart configuration. Additionally, each one of the first and second frame-supporting structures can include the above-mentioned legs-retaining member and the above-mentioned group of longitudinally extending frame-supporting legs being engageable with the legs-retaining member. The longitudinally extending frame-supporting legs can be engaged with the legs-retaining member so that they can extend in a different orientation, with their waterbed-engaging ends being spaced apart from one another. In one scenario, an orientation of each one of the longitudinally extending frame-supporting legs is predetermined when engaged with the legs-retaining member. In one scenario, a distance between a legs-retaining member and a waterbed-engaging end of a respective longitudinally extending frame-supporting leg can be adjusted so that the cofferdam web-supporting frame assembly can be supported properly over an uneven waterbed. For example, each longitudinally extending frame-supporting leg can be slidable relative to its respective legs-retaining member until the desired configuration (i.e., the desired orientation and/or height) is reached and then secured to the legs-retaining member, as described in more detail below.

Referring to the drawings, and more particularly to FIG. 1, there is shown a cofferdam web-supporting frame assembly 10 in accordance with a non-limitative embodiment. The cofferdam web-supporting frame assembly 10 includes the first frame-supporting structure 13, the second frame-supporting structure 15 at least partially spaced-apart from the first frame-supporting structure 13, as well as the connecting assembly 50, which connects the first and second frame-supporting structures 13, 15 to each other (for instance upper portions thereof, for instance the apexes 60, 62 thereof), and defines an exterior side 11.

For instance, the apexes 60, 62 of the first and second frame-supporting structures 13, 15 are spaced apart from each other from a length comprised between about 20 cm and about 150 cm. In some embodiments, the distance between the apexes of the first and second frame-supporting structures 13, 15 is comprised between about 50 cm and about 100 cm. In some other embodiments, the distance between the apexes of the first and second frame-supporting structures 13, 15 is comprised between about 60 cm and about 80 cm.

As perhaps best seen in FIG. 2, the first frame-supporting structure 13 includes the first legs-retaining member 22 forming at least partially the first apex 60 as well as the first group of longitudinally extending frame-supporting legs 12, 12*a*, 12*b*, 12*c* engaged with the first legs-retaining member 22, as described in more detail below. Indeed, each longitudinally extending frame-supporting leg 12*a*, 12*b*, 12*c* extends between the waterbed-engaging end 16 thereof and an upper end 18 and has an upper portion 17. For instance, the upper portion 17 of the frame-supporting legs 12 is shaped, sized and configured so as to be engaged with the first legs-retaining member 22. As described in more detail below, the first legs-retaining member 22 is configured so that each of the longitudinally extending frame-supporting legs 12*a*, 12*b*, 12*c* of the first group can extend in a different orientation, relative to one another, with their waterbed-engaging ends 16 being spaced apart from one another when the first frame-supporting structure 13 is configured in the usage configuration. Hereinafter, the orientation is intended to mean an angular position or a direction of the longitudinally extending frame-supporting legs 12*a*, 12*b*, 12*c* with respect to a surface of the waterbed.

In the non-limitative embodiment shown, the first frame-supporting structure 13 includes the three longitudinally extending frame-supporting legs 12*a*, 12*b*, 12*c*, but it is appreciated that it can include more than three legs. In the non-limitative embodiment shown, when engaged with the first legs-retaining member 22, the portions of the longitudinally extending frame-supporting legs 12*a*, 12*b*, 12*c* extending downwardly from the first legs-retaining member 22 define together substantially a triangular-based pyramid. In other words, in the embodiment shown, the first and second frame-supporting structures 13, 15 each form a substantially triangular-based pyramid when the corresponding frame-supporting legs are in the usage configuration.

Figure 2:
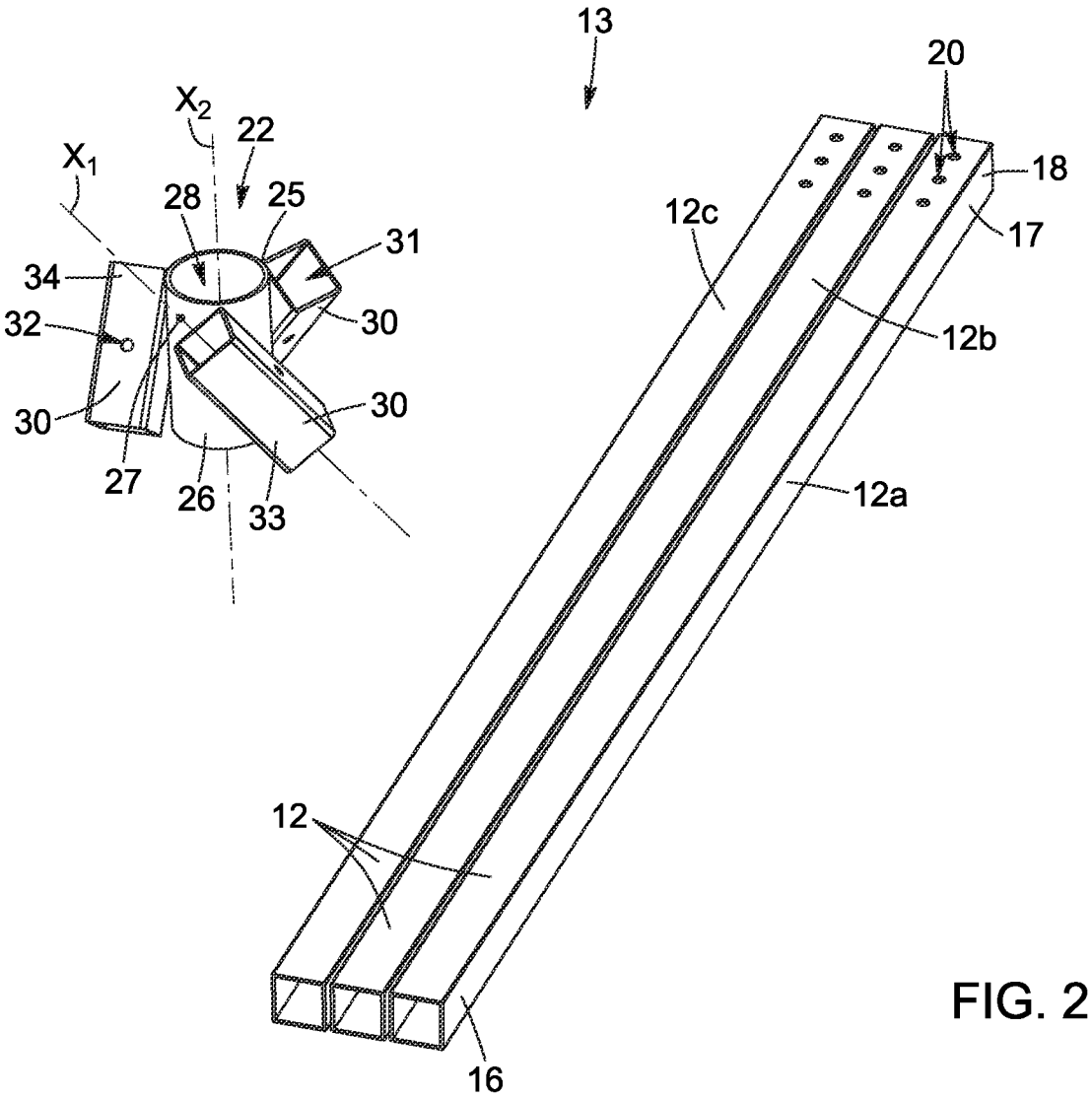
FIG. 2 is a top perspective view of one of the frame-supporting structures of FIG. 1 in a storage configuration.

Still referring to the non-limitative embodiment of FIGS. 1 and 2 collectively, the second frame-supporting structure 15 includes the second legs-retaining member 24 forming at least partially the second apex 62 as well as a second group of longitudinally extending frame-supporting legs 14*a*, 14*b*,

14*c*, 14 which are engaged with the second legs-retaining member 24. Each longitudinally extending frame-supporting leg 14*a*, 14*b*, 14*c* also extends between the waterbed-engaging end 16 thereof and an upper end 18 and, similarly, has an upper portion 19. For instance, the upper portion of the frame-supporting legs is shaped, sized and configured so as to be engaged with the second legs-retaining member 24. As described in more details below, the second legs-retaining member 24 is configured so that each of the longitudinally extending frame-supporting legs 14, 14*a*, 14*b*, 14*c* of the second group can extend in a different orientation with their waterbed-engaging ends 16 being spaced apart from one another. As detailed below, the first and second groups of frame-supporting legs 12, 14 are removably mounted respectively to the first and second legs-retaining members 22, 24, respectively.

In the embodiment shown, the first and second frame-supporting structures 13, 15 have a similar shape, so that the following description of one of the frame-supporting structures 13, 15 will apply to any of them.

Referring now more particularly to the non-limitative embodiment of FIG. 2, each longitudinally extending frame-supporting leg 12*a*, 12*b*, 12*c* which extends between its waterbed-engaging end 16 and its upper end 18, includes a plurality of pairs of locking apertures 20 spaced-apart along a length thereof, and about the upper end 18, or upper portion 17 thereof. Each pair of locking apertures 20 is configured so as to releasably receive a mechanical fastener therein, as described in more detail below.

Legs-Retaining Member (or Leas-Connecting Member)

Still referring to the non-limitative embodiment of FIG. 2, the legs-retaining member 22 includes a main portion 26—or legs-connecting body 26—defining a longitudinally extending channel 28 (or post-receiving channel 28). In the embodiment shown, the post-receiving channel 28 has longitudinal opposed opened ends. The connecting assembly 50 (shown in FIG. 1) is engaged (for instance removably) with the post-receiving channel 28 of the first legs-retaining member 22. The legs-retaining member 22 further comprises a plurality of longitudinally extending leg-receiving tubes 30, or leg-receiving conduits 30 (or leg-receiving sleeves 30) mounted to or formed integral with an outer surface of the legs-connecting body 26. For instance, the leg-receiving sleeves 30 extend outwardly from the legs-connecting body 26 (or main portion 26) and are mounted thereto. Indeed, the plurality of longitudinally extending leg-receiving tubes 30 are spaced-apart along a perimeter defined by a peripheral wall 25 of the main portion 26. For instance, the plurality of leg-receiving tubes 30 are regularly spaced apart from each other around the legs-connecting body 26. Less or more tubes 30 can extend from the main portion 26. For instance, the plurality of longitudinally extending leg-receiving tubes 30 can be secured to the peripheral wall 25 of the main portion 26.

Each longitudinally extending leg-receiving tube 30 defines a longitudinally extending leg-receiving channel 31 with longitudinal opened ends. Each longitudinally extending leg-receiving tube 30 is also shaped, sized and configured so that an upper portion 17 of a respective longitudinally extending frame-supporting leg 12*a*, 12*b*, 12*c* can be releasably and slidably received within the longitudinally extending leg-receiving channel 31 until the longitudinally extending frame-supporting legs 12*a*, 12*b*, 12*c* are secured to the legs-retaining member 22. It is thus understood that the frame-supporting legs are removably engaged with the corresponding leg-receiving sleeves 30. The longitudinally extending frame-supporting legs 12*a*, 12*b*, 12*c* and the longitudinally extending leg-receiving tube 30 can thus take any shape, size or configuration providing such releasable engagement. Moreover, each longitudinally extending leg-receiving tube 30 includes a peripheral wall 33 and a pair of opposed locking apertures 32 (i.e., formed in facing portions of the peripheral wall 33) which extend therethrough. The locking apertures 32 are configured so as to releasably receive the mechanical fastener therein, as described in more detail below.

Therefore, in a non-limitative embodiment, each cofferdam web-supporting frame assembly 10 can further include a plurality of suitable mechanical fasteners (not shown) to detachably and/or removably secure the plurality of longitudinally extending frame-supporting legs 12*a*, 12*b*, 12*c*, 14*a*, 14*b*, 14*c* to the first and second legs-retaining members 22, 24, respectively. For example, each mechanical fastener can be of a sufficient length such that a distal end thereof can pass through a first one of the locking apertures 32 extending through the peripheral wall 33 of a longitudinally extending leg-receiving tube 30, through both locking apertures 20 that extend through a longitudinally extending frame-supporting leg 12*a*, 12*b*, 12*c*, 14*a*, 14*b* or 14*c* and through a second one of the locking apertures 32 (i.e., found opposite to the first one of the locking apertures 32) that extends through the peripheral wall 33 of the longitudinally extending leg-receiving tube 30.

Since the upper portions 17 of the longitudinally extending frame-supporting legs 12*a*, 12*b*, 12*c* are shaped, sized and configured so as to be releasably and slidably received within a corresponding one of the longitudinally extending leg-receiving channels 31 of the longitudinally extending leg-receiving tubes 30 (or leg-receiving sleeve 30), when the distal ends of the mechanical fasteners extend through the locking apertures 20 and 32 that extend through the longitudinally extending leg-receiving tubes 30 and through the longitudinally extending frame-supporting legs 12*a*, 12*b*, 12*c*, 14*a*, 14*b* or 14*c* respectively, and nuts, for example, are fastened thereto, the longitudinally extending frame-supporting legs 12*a*, 12*b*, 12*c*, 14*a*, 14*b*, 14*c* are held securely in their respective orientation with their waterbed-engaging ends 16 being spaced-apart from one another for contacting with the waterbed.

It is noted that in some assembling configurations, at least some of the longitudinally extending frame-supporting legs 12*a*, 12*b*, 12*c* can have their upper ends 18 extending upwardly from their respective longitudinally extending leg-receiving tubes 30, past the upper longitudinal opened ends. Thus, depending on a contour of the waterbed, the distance between a waterbed-engaging end 16 of a respective longitudinally extending frame-supporting leg 12*a*, 12*b*, 12*c* and its corresponding legs-retaining member 22 can be adjusted. Therefore, aligning apertures 32 with a pair of apertures 20 that is closer to the upper end 18 will allow the waterbed-engaging end 16 to be supported by a waterbed surface that is deeper underneath the water surface. On the other hand, aligning apertures 32 with a pair of apertures 20 that is further spaced-apart from the upper end 18 will allow the cofferdam system to be used, even when the waterbed, or a section of the waterbed, is closer to the water surface. Such feature of the cofferdam supporting frame assembly 10 can allow a user to adjust each frame-supporting structure 13, 15 and even each longitudinally extending frame-supporting leg 12*a*, 12*b*, 12*c*, 14*a*, 14*b*, 14*c* independently (i.e., with lengths that can vary), and can allow installation of a cofferdam system 90 even in regions of the watercourse where the waterbed is uneven. Indeed, as mentioned above, the distance between a waterbed-engaging end 16 and a corresponding legs-retaining member 22, 24 can vary for each longitudinally extending frame-supporting leg 12*a*, 12*b*, 12*c*, 14*a*, 14*b*, 14*c*, thus allowing the cofferdam system to be supported by almost every waterbed surface.

It is noted that a person skilled in the art to which the cofferdam system pertains would understand that any suitable mechanical fastener can be used to detachably secure the longitudinally extending frame-supporting legs 12*a*, 12*b*, 12*c*, 14*a*, 14*b*, 14*c* to the first and second legs-retaining members 22, 24. In one scenario, each mechanical fastener can be integral with the upper portion 17, 19 of a corresponding longitudinally extending frame-supporting leg 12*a*, 12*b*, 12*c*, 14*a*, 14*b*, 14*c* and/or with a corresponding longitudinally extending leg-receiving tube 30 of a legs-retaining member 22, 24.

More particularly, and still referring to the non-limitative embodiment of FIG. 2, the peripheral wall 33 of each longitudinally extending leg-receiving tube 30 defines an external surface 34 which can be superposed at least partially to an external surface 27 of the peripheral wall 25 of the main portion 26 (or legs-connecting body 26) so that the longitudinally extending leg-receiving tubes 30 can be secured (for instance welded) to the main portion 26. As best shown in the non-limitative embodiment of FIG. 2, a longitudinal axis $X_1$ of each longitudinally extending leg-receiving tube 30 is tilted at an angle relative to a longitudinal axis $X_2$ of the longitudinally extending channel 28 (or post-receiving channel 28) of the main portion 26, allowing the longitudinally extending frame-supporting legs 12*a*, 12*b*, 12*c*, 14*a*, 14*b*, 14*c* to extend in their respective orientation with the waterbed-engaging ends 16 being spaced apart from one another.

As best shown in FIG. 1, the leg-receiving tube 30 is shaped and dimensioned so that the frame-supporting leg engaged therewith defines a leg-inclination angle $\alpha$ with respect to the longitudinal axis $X_2$ of the longitudinally extending channel 28 (or post-receiving channel 28) of the main portion 26. For instance, the leg-inclination angle $\alpha$ is comprised between about 10 degrees and about 80 degrees. In another embodiment, the leg-inclination angle $\alpha$ is comprised between about 20 degrees and about 70 degrees. In another embodiment, the leg-inclination angle $\alpha$ is comprised between about 30 degrees and about 60 degrees. In yet another embodiment, the leg-inclination angle $\alpha$ is about 45 degrees.

Each longitudinally extending leg-receiving tube 30 can be secured to the main portion 26 using known mechanical fasteners or alternatively, by welding, for example. In one scenario, each longitudinally extending leg-receiving tube 30 can be pivotably mounted to the peripheral wall 25 of the main portion 26, so the longitudinally extending leg-receiving tubes 30 and thus, the longitudinally extending frame-supporting legs 12*a*, 12*b*, 12*c*, 14*a*, 14*b*, 14*c* can extend in different orientations (i.e., the angle defined between a leg and the longitudinally extending channel 28 can vary from one leg to another) and their orientation can be modified. For example, the orientation of the longitudinally extending leg-receiving tubes 30 and thus, of the longitudinally extending frame-supporting legs 12*a*, 12*b*, 12*c*, 14*a*, 14*b*, 14*c*, can be adjusted on site, depending on the waterbed contour, waterbed depth, waterbed configuration, etc. In other words, more or less spacing can be provided between the waterbed-engaging ends 16 of the longitudinally extending frame-supporting legs 12*a*, 12*b*, 12*c*, 14*a*, 14*b*, 14*c* when in the usage configuration. However, it is noted that the longitudinally extending leg-receiving tubes 30 and the main portion 26 of a legs-retaining member 22, 24 can be integrally formed, according to another scenario. It is also noted that other attachment means could be used to releasably engage the upper portions 17, 19 of the longitudinally extending frame-supporting legs 12*a*, 12*b*, 12*c*, 14*a*, 14*b*, 14*c* with the corresponding one of the first and second legs-retaining members 22, 24. In other words, in the embodiment shown, at least one of the frame-supporting legs is slidably mounted to the corresponding leg-receiving sleeve of the corresponding one of the first and second legs-retaining member 22, 24, the distance between the corresponding one of the first and second legs-retaining members and the waterbed-engaging end of the at least one of the frame-supporting legs being adjustable. In yet other words, at least one of the frame-supporting legs is configurable into at least two configurations wherein the leg-retaining member is at two different heights and/or positions with respect to the waterbed when the frame-supporting leg is engaged therewith.

In the non-limitative embodiment shown, the longitudinally extending frame-supporting legs 12*a*, 12*b*, 12*c*, 14*a*, 14*b*, 14*c* are engaged (for instance in a removable manner) with the respective one of the first and second legs-retaining members 22, 24 by inserting into a respective channel of the leg-receiving sleeves of the first and second legs-retaining members 22, 24 and secured for instance through a combination of apertures provided in the longitudinally extending frame-supporting legs 12*a*, 12*b*, 12*c*, 14*a*, 14*b*, 14*c* and the first and second legs-retaining members 22, 24 and mechanical fasteners. However, it is appreciated that the longitudinally extending frame-supporting legs 12*a*, 12*b*, 12*c*, 14*a*, 14*b*, 14*c* can be engaged with the respective one of the first and second legs-retaining members 22, 24 by a different mechanical assembly. For instance and without being limitative, the first and second legs-retaining members could be provided with rails extending at least partially therealong and the longitudinally extending frame-supporting legs could be provided with complementary male members engageable into a respective one of the rails. Once the desired configuration of a respective one of the longitudinally extending frame-supporting legs would be reached, it could be secured in the selected configuration with a lock, as it is known in the art. Therefore, in such assembly, the possible positionings of the longitudinally extending frame-supporting legs with respect to the first and second legs-retaining members are continuous (in comparison with the system including apertures which provide a limited and predetermined positioning corresponding to the available apertures).

In the embodiment shown, as represented for instance in FIG. 2, the legs-connecting body 26 has a substantially cylindrical shape and the post-receiving channel 28 opens into upper and lower end portions of the legs-connecting body 26 (or central core 26). In the embodiment shown, the leg-receiving tubes 30 (or leg-receiving sleeves 30) have a substantially squared cross-section.

It is appreciated that the shape and the configuration of the legs-retaining member as well as the shape, the configuration, the number and/or the respective location of the legs-connecting body and the leg-receiving sleeves thereof can vary from the embodiment shown.

As best shown in FIGS. 4 to 9, a second possible embodiment of the legs-retaining member is disclosed. Similar to the first embodiment, the legs-retaining member 122 forms an apex 160 of a frame-supporting structure and comprises a legs-connecting body 126 at least partially delimiting a post-receiving channel 128 and a plurality of leg-receiving sleeves 130 mounted to or formed integral with an outer surface of the legs-connecting body 126. For instance, the plurality of leg-receiving tubes 130 are regularly spaced apart from each other around the legs-connecting body 126. In the embodiment shown, the leg-receiving sleeve 130 comprises a leg-engaging end 133 opening into a leg-receiving channel 131 thereof, whereas an opposed body-mounting end 135 of the leg-receiving sleeve 130 is closed and mounted to or formed integral with the legs-connecting body 126.

Figure 8:
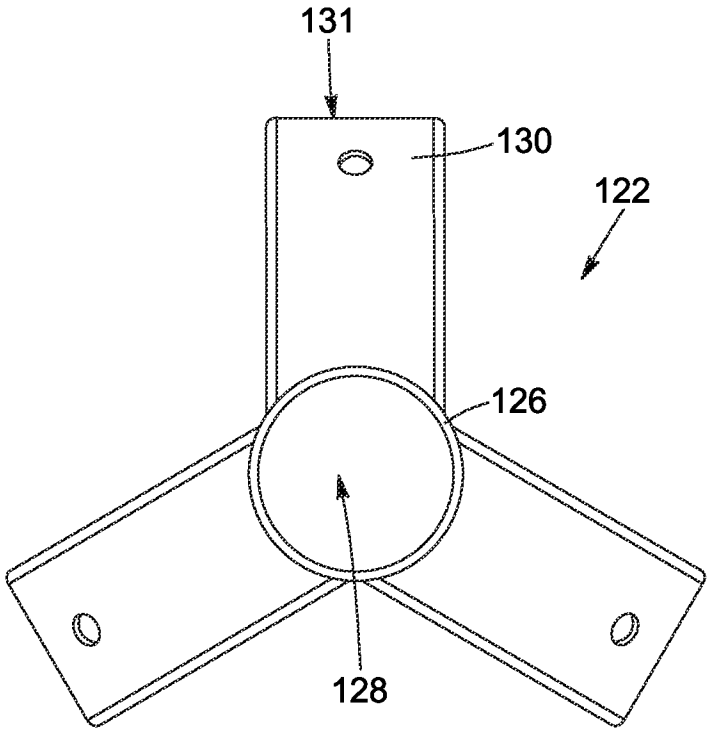
FIG. 8 is a top elevational view of one of the legs-retaining members of FIG. 4.
Figure 9:
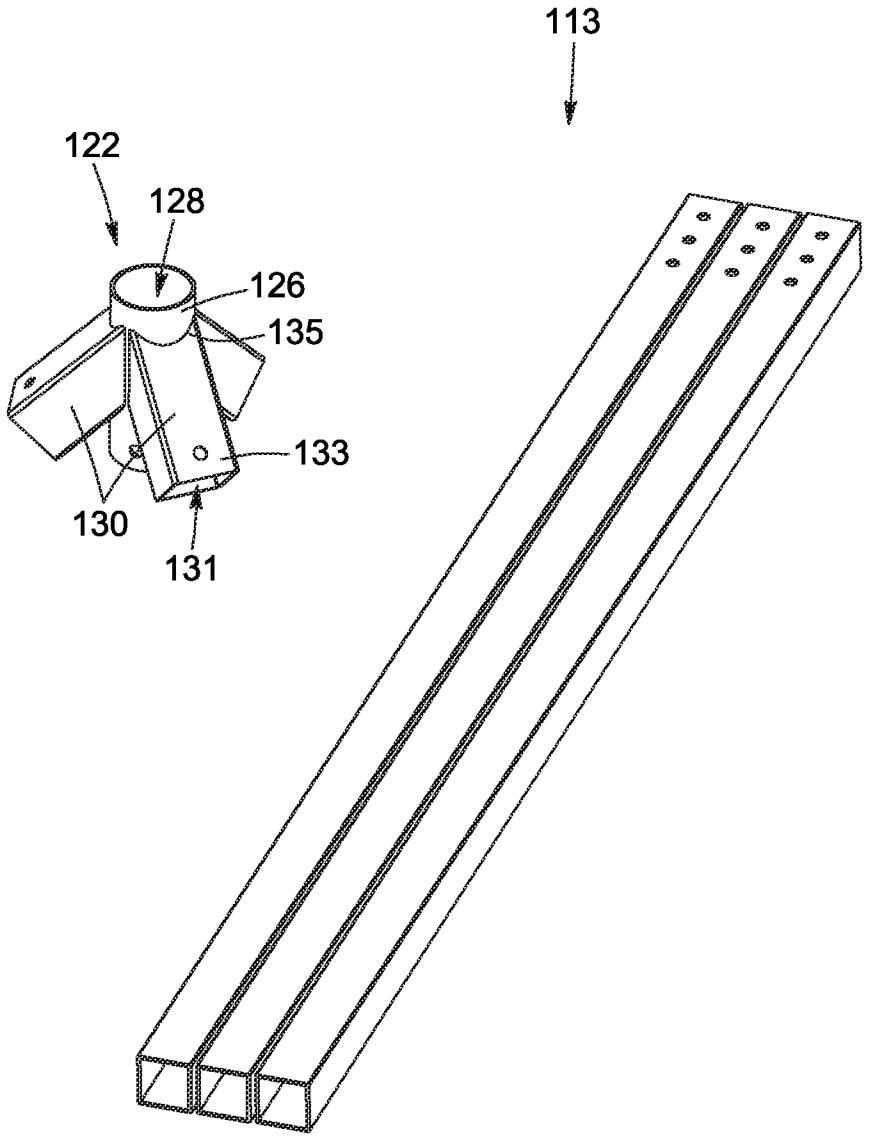
FIG. 9 is a top perspective view of one of the frame-supporting structures of FIG. 4 in a storage configuration.

As best shown in FIG. 8, leg-receiving directions defined by the plurality of the leg-receiving tubes 130 (or leg-receiving sleeve 130) (or by the leg-receiving channels 131 at least partially delimited thereby) converge toward each other in the vicinity of or within the central core 126 (or legs-connecting body 126) of the legs-retaining member 122.

Figure 12:
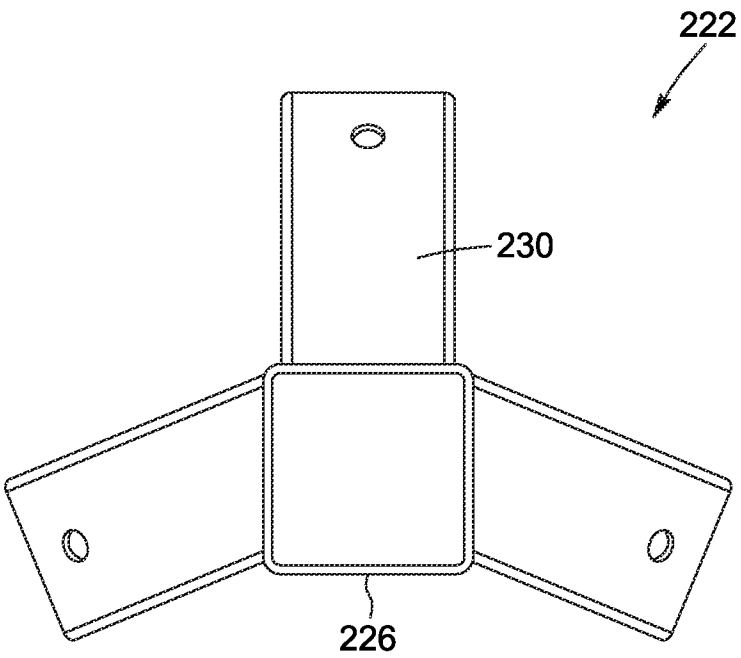
FIG. 12 is a top elevational view of a legs-retaining member in accordance with another embodiment.

FIG. 12 represents another possible embodiment of a legs-retaining member 222 comprising a central core 226 (or legs-connecting body 226) having a substantially squared cross-section and a plurality of the leg-receiving tubes 230 (or leg-receiving sleeves 230) mounted to or formed integral with an outer surface of the legs-connecting body 226, the leg-receiving tubes 230 having a substantially squared cross-section.

For instance, the legs-connecting body has a length comprised between about 5 cm and about 30 cm. In some embodiments, the length of the legs-connecting body is comprised between about 7 cm and about 25 cm. In some embodiments, the length of the legs-connecting body is comprised between about 10 cm and about 20 cm. In some other embodiments, the length of the legs-connecting body is about 15 cm.

For instance, an outer cross-section of the legs-connecting body is comprised between about 2 cm and about 10 cm. In some embodiments, the outer cross-section of the legs-connecting body is comprised between about 3 cm and about 7 cm. In some embodiments, the outer cross-section of the legs-connecting body is about 5 cm.

For instance, the leg-receiving tube has a length comprised between about 5 cm and about 15 cm. In some embodiments, the length of the leg-receiving tube is comprised between about 6 cm and about 12 cm. In some embodiments, the length of the leg-receiving tube is about 10 cm.

For instance, an outer cross-section of the leg-receiving tube is comprised between about 2 cm and about 10 cm. In some embodiments, the outer cross-section of the leg-receiving tube is comprised between about 3 cm and about 7 cm. In some embodiments, the outer cross-section of the leg-receiving tube is about 5 cm.

Longitudinally Extending Frame-Supporting Legs

It is appreciated that the shape and the configuration of the longitudinally extending frame-supporting legs can vary from the embodiment shown.

For instance, the disclosure is not limited to frame-supporting legs having a substantially square cross-section, as long as the shape and the dimensions of the cross-section of the frame-supporting legs (at least of the upper ends thereof) correspond substantially to the shape and the dimensions of the leg-receiving tubes with which the legs are configured to be engaged. For instance, frame-supporting legs with a substantially circular cross-section could be conceived.

In the embodiment shown, the frame-supporting legs are at least partially made of a metallic material, such as steel, aluminum, etc. The frame-supporting legs also may be at least partially formed of wood, plastic or any other suitable material.

Figure 10:
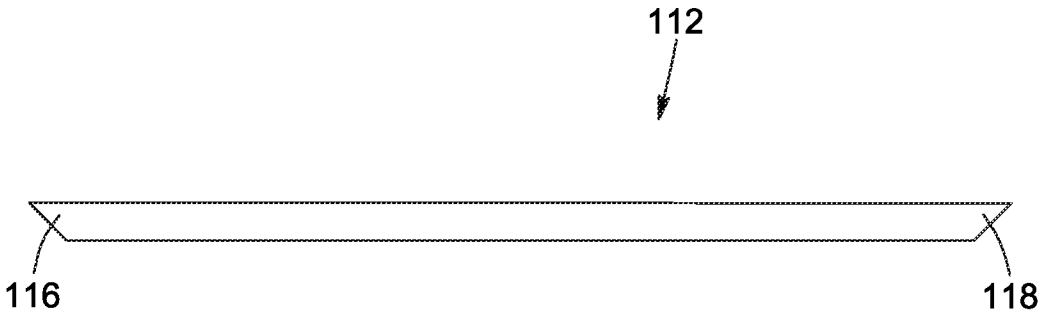
FIG. 10 is a side elevational view of a longitudinally extending frame-supporting leg in accordance with another embodiment.
Figure 11:
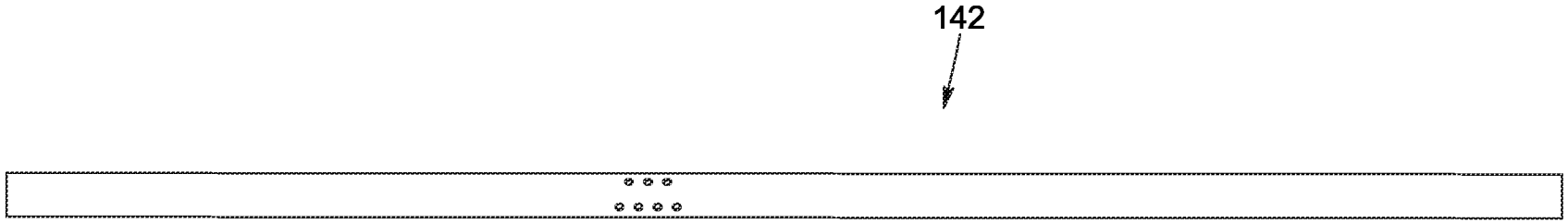
FIG. 11 is a side elevational view of one of the extension posts of FIG. 3.

As best shown in FIG. 2, the frame-supporting legs 12 have a substantially parallelepipedal shape with the end portions thereof (i.e., the waterbed engaging end and the upper end) defining planes extending substantially perpendicularly to a longitudinal direction of the frame-supporting leg. It could also be conceived, as best shown in FIG. 10, a frame-supporting leg 112 having at least one of the upper and waterbed-engaging ends 118, 116 being substantially tapered. When the waterbed-engaging end is substantially tapered, a cooperation between the frame-supporting leg and the waterbed is improved, thus contributing to the stability of the installation of the cofferdam web-supporting frame assembly. When the upper end is substantially tapered, a cooperation between the frame-supporting leg and the corresponding legs-retaining member is improved, thus contributing to the stability of the installation of the cofferdam web-supporting frame assembly.

For instance, the frame-supporting leg has an outer cross-section comprised between about 1 cm and about 5 cm. In some embodiments, the outer cross-section of the frame-supporting leg is comprised between about 2 cm and about 4 cm.

For instance, the frame-supporting leg has a length comprised between about 40 cm and about 200 cm. In some embodiments, the length of the frame-supporting leg is comprised between about 50 cm and about 150 cm. In some embodiments, the length of the frame-supporting leg is comprised between about 70 cm and about 120 cm. In some embodiments, the length of the frame-supporting leg is about 90 cm.

For instance, at least one of the frame-supporting legs is at least partially retractable and/or comprises a telescopic assembly in order to further adjust the distance between the legs-retaining member and the waterbed-engaging end of the corresponding frame-supporting leg.

Connecting Assembly (or Structure-Connecting Assembly)

As mentioned above, and as best shown in the non-limitative embodiment of FIG. 1, the cofferdam web-supporting frame assembly 10 further includes the connecting assembly 50 which is shaped and dimensioned to connect the first and second frame-supporting structures 13, 15 (for instance the first and second apexes 60, 62 thereof).

In the first embodiment shown, the connecting assembly 50 comprises a connecting post 36 (or web-supporting transversal member 36), which is mounted (for instance in a removable manner), either directly or indirectly, to the upper portions (or apexes) of the first and second frame-supporting structures 13, 15, respectively.

In the embodiment shown, the web-supporting transversal member 36 is substantially U-shaped and comprises a central web-supporting transversal member 37 and opposed first and second longitudinal end portions 38, 40 (or opposed first and second supporting structure-mounting end portions) which are shaped and dimensioned to be mounted (for instance in a removable manner), either directly or indirectly, to the first and second frame-supporting structures 13, 15.

For instance, the first and second longitudinal end portions 38, 40 extend transversally (for instance substantially perpendicularly) to the central web-supporting transversal member 37 and are configured to be slidably and releasably mounted to the first and second frame-supporting structures (for instance engaged with the post-receiving channels at least partially delimited by the legs-connecting body of the corresponding legs-retaining member thereof).

In other words, the web-supporting transversal member 36 extends between the first end portion 38 that is releasably securable to the main portion 26 of the first legs-retaining member 22, and the second end portion 40 that is releasably securable to the main portion 26 of the second legs-retaining member 24. In one scenario, and still referring to the non-limitative embodiment of FIG. 1, the first end portion 38 of the connecting post 36 can be releasably and slidably received within the longitudinally extending channel 28 of the first legs-retaining member 22, and optionally secured to the main portion 26, while the second end portion 40 of the connecting post 36 can be releasably and slidably received within the longitudinally extending channel 28 of the second legs-retaining member 24, and optionally secured to the main portion 26.

As represented in FIG. 1, the first and second supporting structure-mounting end portions 38, 40 are directly engaged with the first and second apexes 60, 62 of the first and second frame-supporting structures 13, 15.

Figure 3:
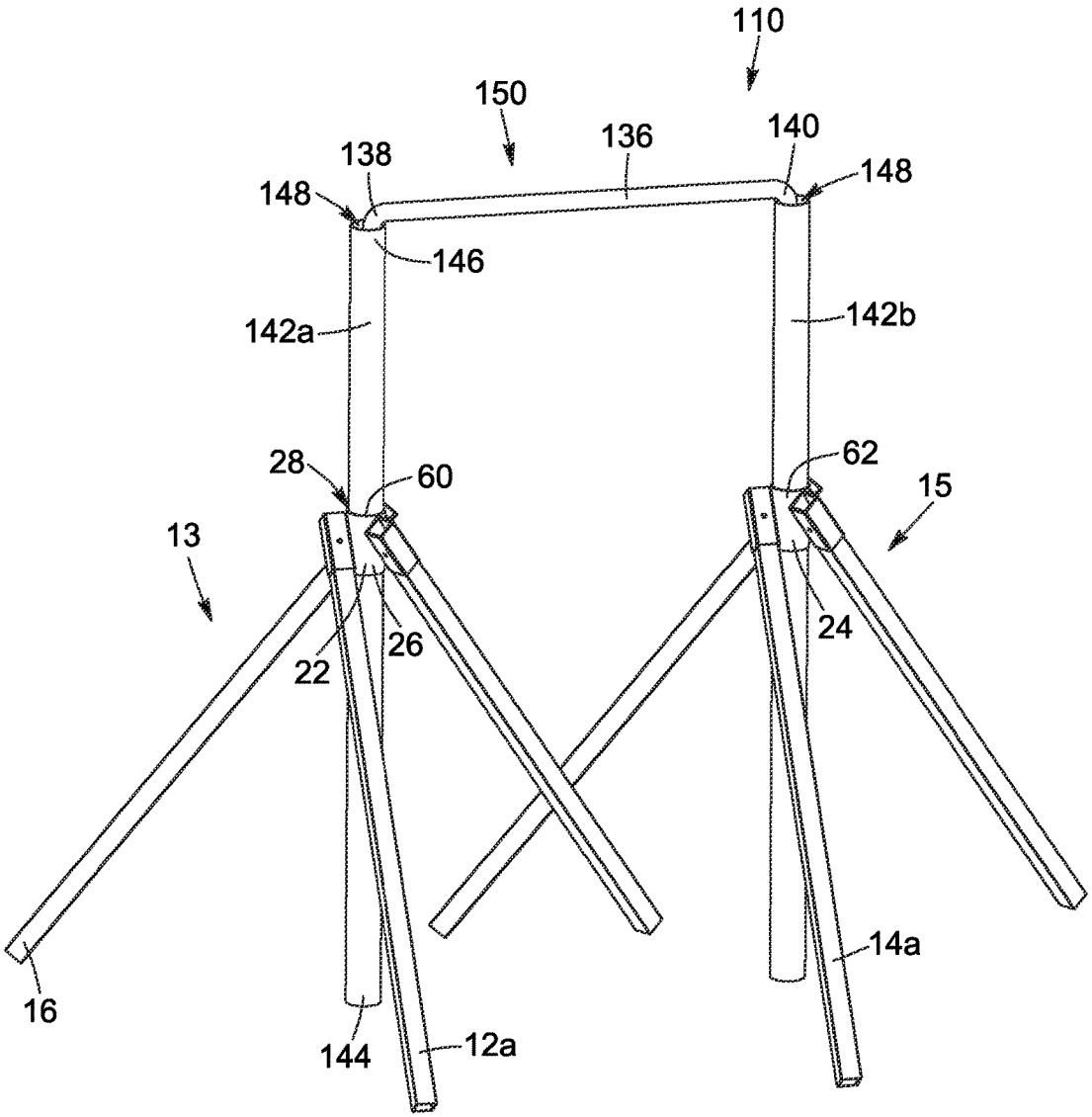
FIG. 3 is a side perspective view of a cofferdam web-supporting frame assembly in accordance with a second embodiment, the cofferdam web-supporting frame assembly comprising the first and second frame-supporting structures of FIG. 1 and a connecting assembly comprising a web-supporting transversal member and first and second extension posts.

Referring now to FIG. 3, it could also be conceived a connecting assembly 150 comprising a web-supporting transversal member 136 having first and second opposed longitudinal end portions 138 and 140. The connecting assembly 150 further comprises extension posts 142, such as first and second extension posts 142*a*, 142*b* (or longitudinally extending posts 142*a*, 142*b*), removably mounted respectively to the first and second apexes 60, 62 (for instance slidably mounted thereto, for instance slidably mounted to the corresponding legs-connecting body of the first and second legs-retaining member) and respectively to the first and second longitudinal end portions 138, 140 of the web-supporting transversal member 136.

Each longitudinally extending post 142*a*, 142*b* (or first and second extension posts 142*a*, 142*b*) is for instance substantially tubular and defines a post longitudinally extending channel 148 with longitudinal opened ends. For instance, the first and second extension posts 142*a*, 142*b* both comprise a waterbed-engaging end 144 and an opposed upper end 146 (or connecting post-engaging end 146 or transversal member-engaging end 146). In the embodiment shown, the longitudinally extending posts 142*a*, 142*b* are shaped, sized and configured so as to be releasably and slidably received within the longitudinally extending channels 28 of the main portions 26 (or legs-connecting body 26) of the first and second legs-retaining members 22, 24 and then secured thereto in a selected configuration. According to this scenario, instead of being releasably and slidably received within the longitudinally extending channels 28 of the main portions 26 of the first and second legs-retaining members 22, 24, the first and second longitudinal ends 138, 140 of the connecting post 136 (or web-supporting transversal member 136) can be releasably and slidably engaged with the longitudinally extending posts 142*a*, 142*b* by being slidably received within the post longitudinally extending channels 148, through the longitudinal opened ends thereof, while allowing the waterbed-engaging ends 144 of the longitudinally extending posts 142*a*, 142*b* to engage with the waterbed, together with the waterbed-engaging ends 16 of the longitudinally extending frame-supporting legs 12*a*, 12*b*, 12*c*, 14*a*, 14*b*, 14*c*. It is thus understood that, in the embodiment shown, an inner diameter of the post longitudinally extending channels 148, at least at the upper end 146 thereof, is slightly larger than an outer diameter of the first and second longitudinal ends 138, 140 of the connecting post 136. Other cooperation and assembling means between the connecting post 136 and the first and second extension posts 142*a*, 142*b* could be conceived.

For instance, the extension post has an outer cross-section comprised between about 2 cm and about 10 cm. In some embodiments, the outer cross-section of the extension post is comprised between about 3 cm and about 7 cm. In some other embodiments, the outer cross-section of the extension post is about 4 cm.

An overall height of the cofferdam web-supporting frame assembly 110 shown in FIG. 3 is thus greater than an overall height of the cofferdam web-supporting frame assembly 10 shown in FIG. 1, so it can be used for instance in deeper areas of the watercourse or waterway to build the cofferdam system. For instance, the overall height of the cofferdam web-supporting frame assembly is comprised between about 50 cm and about 250 cm. In another embodiment, the overall height of the cofferdam web-supporting frame assembly is comprised between about 60 cm and about 200 cm. In another embodiment, the overall height of the cofferdam web-supporting frame assembly is comprised between about 70 cm and about 160 cm.

Indeed, according to the depth under the water surface at which the waterbed is located, a user can decide to use the cofferdam web-supporting frame assembly 10 as shown in the non-limitative embodiment of FIG. 1, with the connecting assembly 50 being constituted of the web-supporting transversal member 36 and being directly and releasably secured to the upper portions or apexes of the first and second frame-supporting structures 13, 15 (i.e., with the longitudinal end portions 38, 40 of the web-supporting transversal member 36 being releasably and slidably receiving within the longitudinally extending channels 28 of the main portions 26 of the first and second legs-retaining members 22, 24), or alternatively, to use the cofferdam web-supporting frame assembly 110 as shown in the non-limitative embodiment of FIG. 3, with the connecting assembly 150 comprising the web-supporting transversal member 136 and the longitudinally extending posts 142*a*, 142*b*, with the web-supporting transversal member 136 being releasably mounted to or engaged with the connecting post-engaging ends 146 of the longitudinally extending posts 142*a*, 142*b* (i.e., with the longitudinal end portions 138, 140 of the connecting post 136 being releasably and slidably received within the post longitudinally extending channels 148 of the longitudinally extending posts 142*a*, 142*b*), or to use a combination thereof. Thus, for example, a plurality of assemblies 10, 110 can be spaced-apart along a perimeter delimiting the enclosed working area. Along the perimeter, assemblies 110 shown in FIG. 3 can be used where the waterbed is relatively deep under the water surface, and assemblies 10 shown in FIG. 1 can be used where the waterbed is relatively close to the water surface.

It is appreciated that the shape and the configuration of the connecting assembly, as well as the shape, the configuration and/or the relative location of the web-supporting transversal member and/or the first and second extension posts thereof can vary from the embodiment shown.

It could for instance be conceived a connecting assembly with at least one of the web-supporting transversal member and the first and second extension posts thereof being at least partially retractable and/or comprising a telescopic assembly, in order to easily adjust dimensions of the connecting assembly to the cofferdam system they are configured to form once assembled.

Modular Cofferdam Web-Supporting Assembly

The components of the cofferdam web-supporting frame assemblies 10, 110 of the non-limitative embodiments of FIGS. 1 to 3 (i.e., the longitudinally extending frame-supporting legs, the legs-retaining members, the connecting assemblies comprising a web-supporting transversal member mountable either directly or indirectly via first and second extension posts of the connecting assemblies to the first and second frame-supporting structures, the suitable mechanical fasteners, etc.), can be assembled together, for instance above the water surface, prior to submerging the cofferdam web-supporting frame assemblies 10, 110 into the body of water, or directly under water, by professional divers, for example. It is also understood that the modular structure of the cofferdam web-supporting frame assemblies makes them easily adaptable to a plurality of configurations of the body of water. It is understood that the different components of the cofferdam web-supporting frame assemblies 10, 110 described above can be easily combined to form numerous configurations of cofferdam web-supporting frame assemblies.

Figure 4:
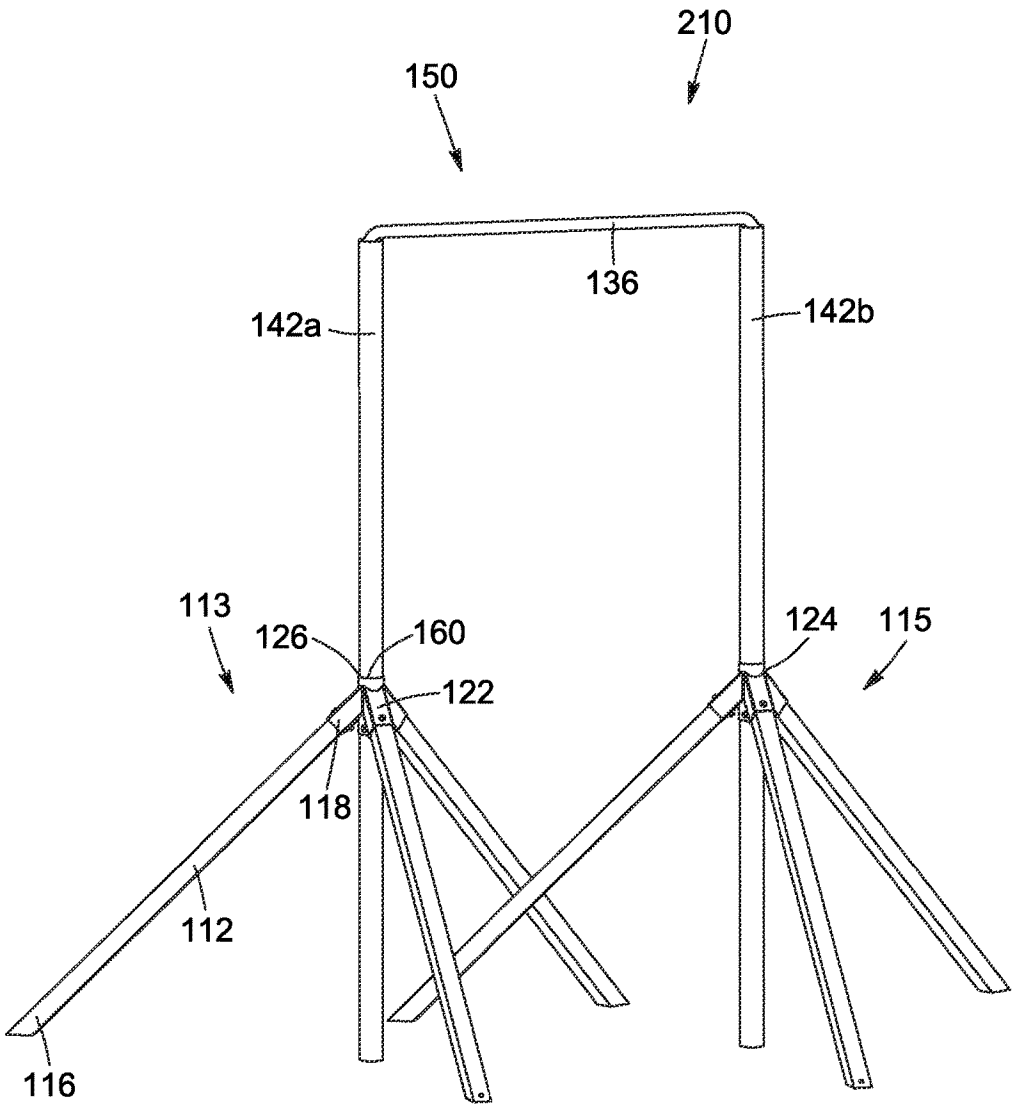
FIG. 4 is a side perspective view of a cofferdam web-supporting frame assembly in accordance with a third embodiment, the cofferdam web-supporting frame assembly comprising first and second frame-supporting structures with legs-retaining members having leg-receiving tubes with closed upper ends, and the connecting assembly of FIG. 3.

As represented in FIG. 4, it could for instance be conceived a cofferdam web-supporting frame assembly 210 comprising first and second frame-supporting structures 113, 115 with legs-retaining members 122, 124 having leg-receiving tubes with closed upper ends, as represented in FIG. 8, with longitudinally extending frame-supporting legs 112 as represented in FIG. 20, with substantially tapered waterbed-engaging and upper ends 116, 118, and with the connecting assembly 150 of FIG. 3.

Figure 5:
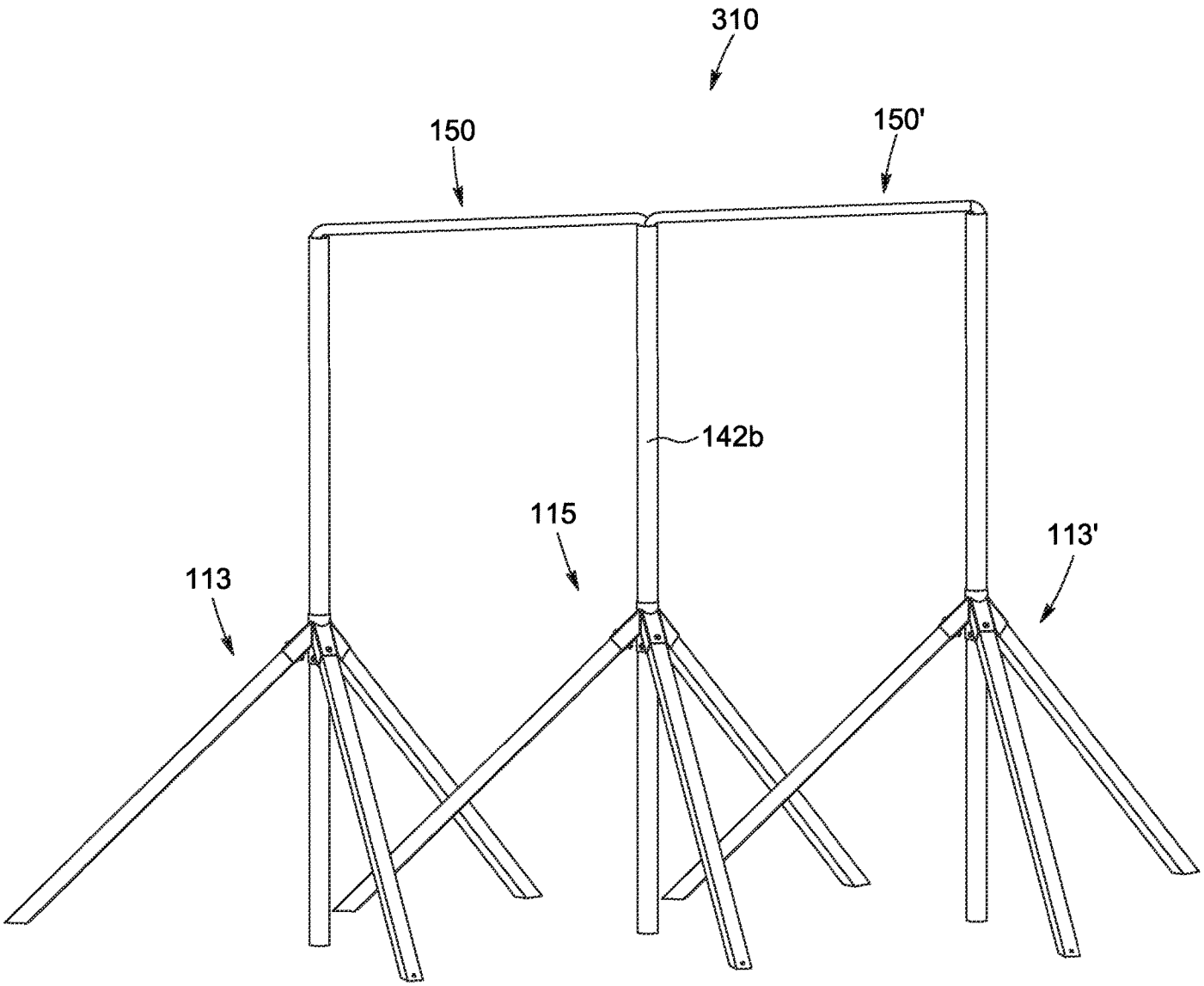
FIG. 5 is a side perspective view of a cofferdam web-supporting frame assembly in accordance with a fourth embodiment, the cofferdam web-supporting frame assembly comprising the first and second frame-supporting structures and the connecting assembly of FIG. 4 and further comprising a third frame-supporting structure and an additional connecting assembly.

As represented in FIG. 5, it could also be conceived a cofferdam web-supporting frame assembly 310 comprising the first and second frame-supporting structures 113, 115 and a first connecting assembly 150 as represented in FIG. 4 and further comprising a third frame-supporting structure 113' and a second connecting assembly 150'. For instance, the first and second connecting assemblies 150, 150' are both removably engaged with the second frame-supporting structure 115, one of the extension posts 142*b* being common to the first and second connecting assemblies 150, 150'.

Figure 7:
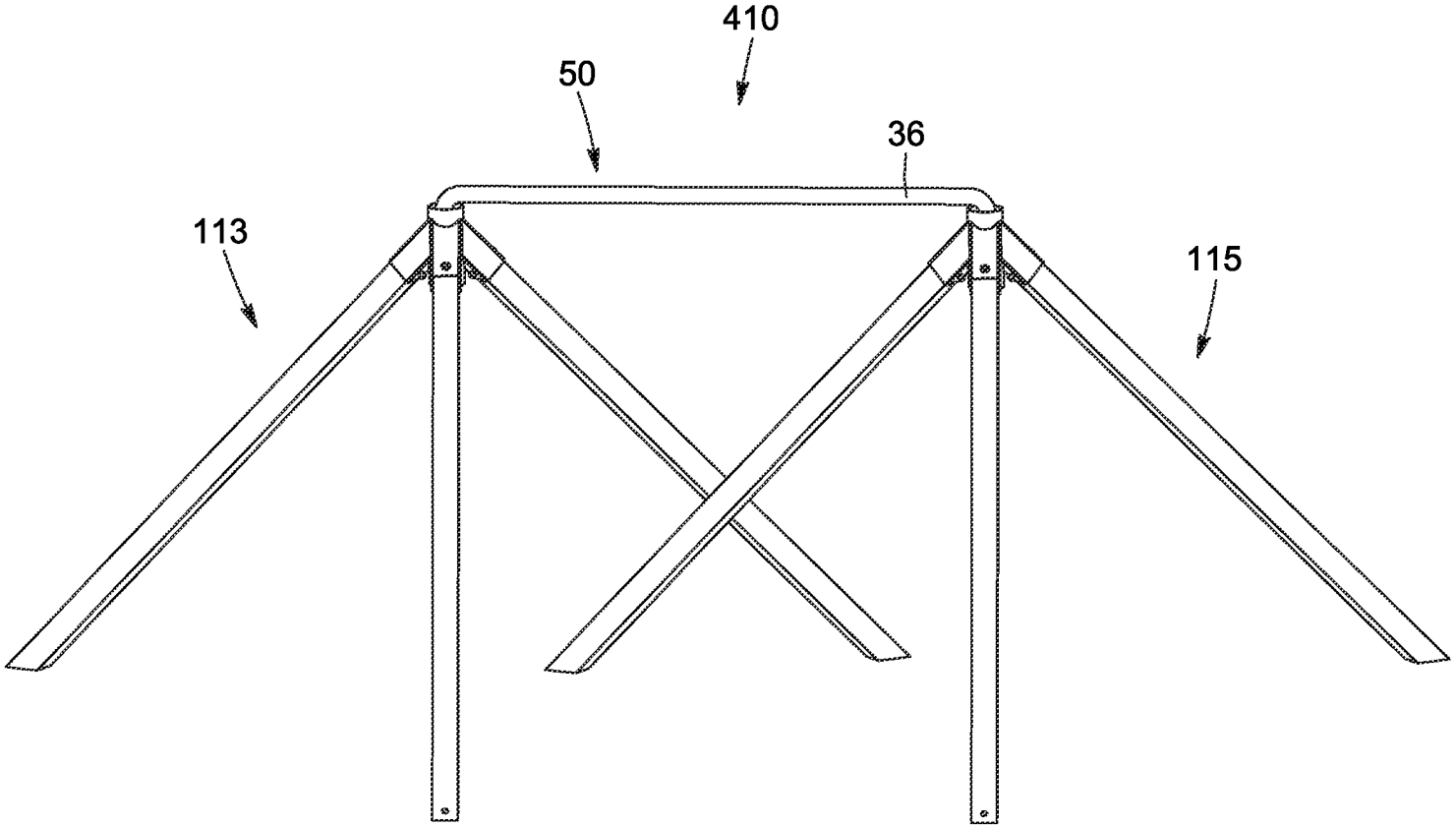
FIG. 7 is a side perspective view of a cofferdam web-supporting frame assembly in accordance with a fifth embodiment, the cofferdam web-supporting frame assembly comprising the first and second frame-supporting structures of FIG. 4 and the connecting assembly of FIG. 1.

As represented in FIG. 7, it could also be conceived a cofferdam web-supporting frame assembly 410 comprising the first and second frame-supporting structures 113, 115 of FIG. 4 and the connecting assembly 50 of FIG. 1.

The possible combinations of the different components of the cofferdam web-supporting frame assemblies are not limited to the represented embodiments.

According to another aspect, there is thus disclosed a kit for forming a cofferdam web-supporting frame assembly comprising at least first and second legs-retaining members, a plurality of longitudinally extending frame-supporting legs removably engageable with the first and second legs-retaining members to form therewith first and second frame-supporting structures. The kit further comprises a connecting assembly removably engageable with the first and second frame-supporting structures (for instance with the first and second legs-retaining members thereof) to connect first and second apexes of the first and second frame-supporting structures to each other.

Figure 6:
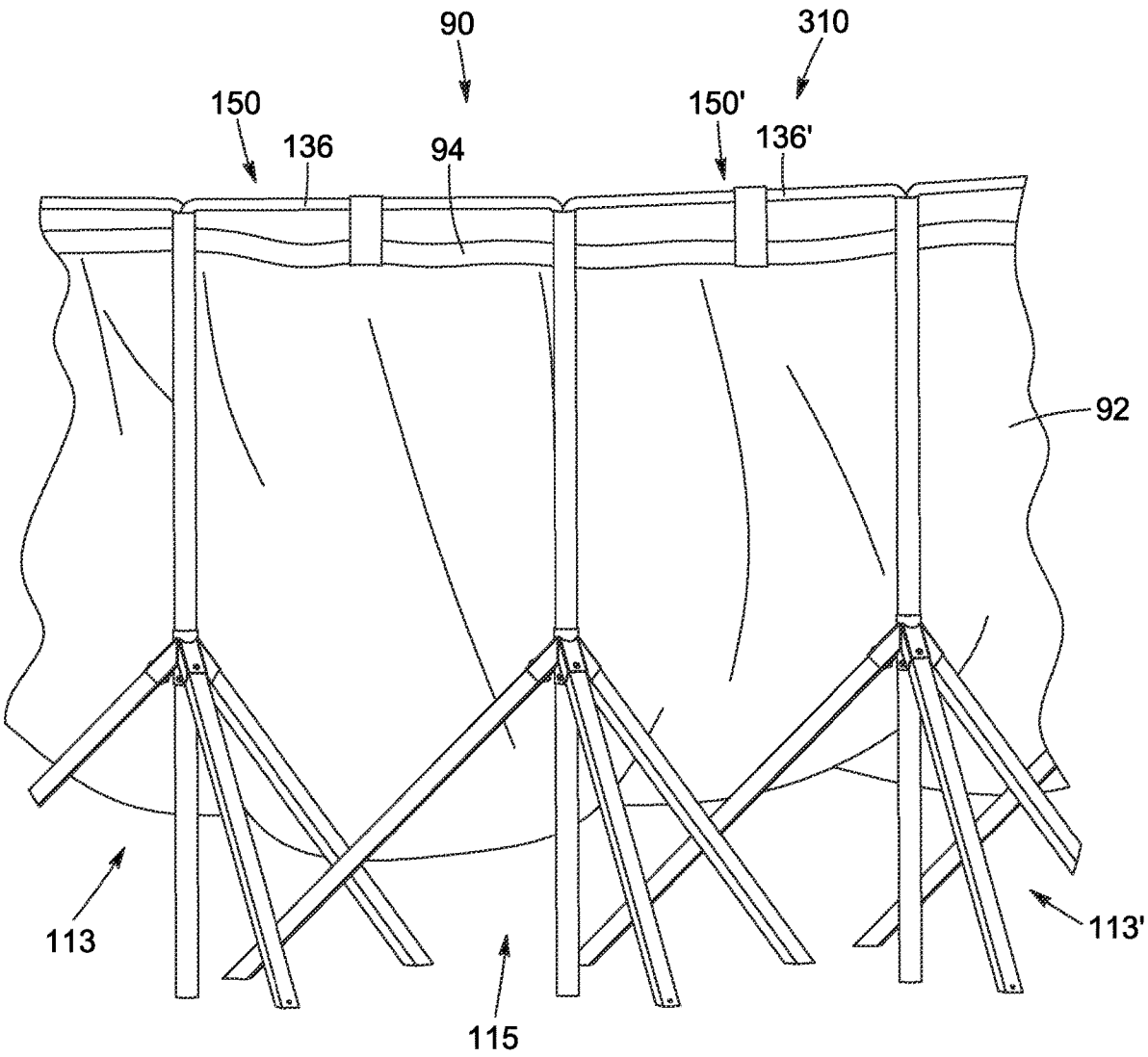
FIG. 6 is a side perspective view of a cofferdam system in accordance with an embodiment, comprising the cofferdam web-supporting frame assembly of FIG. 5 and a flexible impermeable web secured thereto and at least partially covering a water-facing side thereof.

Once the cofferdam web-supporting frame assemblies are properly positioned across the body of water, along the perimeter delimiting the enclosed working area, for example, a substantially flexible impermeable web 92 can be positioned across the body of water, as represented in FIG. 6. The impermeable web 92 can thus be engaged with, and secured to, the cofferdam web support frame assemblies, outwardly thereof (i.e., covering the upstream side or water-facing side of the cofferdam web-supporting frame assemblies), so as to cover substantially the longitudinally extending frame-supporting legs or at least a lower section thereof.

Optionally, it is noted that the flexible impermeable web can be secured to the waterbed. For instance, the flexible impermeable web 92 can comprise a waterbed-engaging edge. On the other hand, each one of the longitudinally extending frame-supporting legs extends in an orientation where they can help prevent the cofferdam web-supporting frame assembly from being pushed downwardly towards the waterbed by the water pressure applied to the substantially flexible impermeable web 92 and thus, to the overall cofferdam system. Water can thus be pumped out from the enclosed working area that is at least partially delimited by the substantially flexible impermeable web 92 so as to provide the substantially dry working area. Such configuration of the cofferdam system allows to pump water out of the formed enclosure, from the dam downstream side, such as to provide the substantially dry working environment from the dam upstream side.

A person skilled in the art to which the cofferdam system pertains would understand that the components of the cofferdam web-supporting frame assembly can be made of a metallic material, such as steel, aluminum, etc., or could be made of any suitable material allowing the assemblies to be self-supportive in the body of water, once submerged therein.

Flexible Impermeable Web

It is noted that more than the above-mentioned substantially flexible impermeable web 92 can be outwardly provided to at least partially cover the cofferdam web-supporting frame assemblies, at least a lower section thereof, in a watertight manner. To secure the flexible impermeable web to the cofferdam web-supporting frame assemblies, an upper longitudinal edge 94 of the flexible impermeable web 92 can be engaged with or secured to the cofferdam web-supporting frame assemblies, for instance to the connecting assemblies 150, 150' (for instance to the web-supporting transversal member 136, 136' thereof). For instance, the flexible impermeable web 92 comprises one or more post-mounting members removably securable to the connecting assemblies.

As mentioned above, optionally, a skirt or lower longitudinal edge of the substantially flexible impermeable web can be secured at a waterway bottom surface using one or more weights (e.g., sand bags, cement blocks, etc.) positioned along a length of the lower longitudinal edge of the substantially flexible impermeable web 92. Additional anchors (not shown) can additionally, or alternatively, extend from the waterbed and/or from the cofferdam web-supporting frame assemblies, to strongly secure the flexible impermeable web to the waterbed and/or to the cofferdam web-supporting frame assemblies, as water applies pressure on the substantially flexible impermeable web. The substantially flexible impermeable web 92 can be a geotextile, or alternatively, be made of a reinforced PVC and can be of a construction similar to a nylon reinforced PVC tarpaulin.

Accordingly, in order to provide the substantially dry environment or enclosure, the cofferdam system 90 needs to be provided across the body of water, before water can be pumped out, so that workers can integrate the area. The steps of releasably engaging the upper portions of the longitudinally extending frame-supporting legs with the first and second legs-retaining members and of releasably securing the connecting assemblies 150, 150' to the upper portions of the frame-supporting structures 113, 115, 113' (i.e., to the legs-retaining members thereof directly or indirectly via the extension posts of the connecting assemblies 150, 150'), can be performed above the water surface (prior to submerging the assemblies), while the step of releasably engaging the substantially flexible impermeable web 92 with the cofferdam web-supporting frame assembly 310 and securing the same thereto can, on the other hand, be performed by a skilled diver, for example, as this step is performed underwater.

According to a depth under the water surface at which the cofferdam system is positioned (or to the depth under the water surface at which the waterbed-engaging ends of the longitudinally extending frame-supporting legs and/or the waterbed-engaging ends of the extension posts of the connecting assemblies are located), distance between the cofferdam web-supporting frame assembly can be less or more. Indeed, a cofferdam system that is found to be deeply positioned under the water surface will need to support more pressure from the body of water than a system that is found to be less deeply positioned under the water surface. Accordingly, when the waterbed-engaging ends are deeply located under the water surface, distance between two adjacent frame web-supporting structures will be less than if the waterbed-engaging ends are less deeply located under the water surface. Indeed, when pressure increases, more frame-supporting structures are required to support the flexible impermeable web being pushed towards the dam downstream side by the body of water coming from the dam upstream side.

It is noted that a layer made of a meshed material (not shown) can optionally be engaged with and secured to the cofferdam web-supporting frame assembly so it can be sandwiched inbetween the assembly and the substantially flexible impermeable web. It is noted that a person skilled in the art to which the cofferdam system pertains would understand that the longitudinally extending frame-supporting legs, the first and second legs-retaining members, the plurality of longitudinally extending leg-receiving tubes, the connecting assembly, and the different components thereof can take any shape, size or configuration, for providing a proper support to the substantially flexible impermeable web, for providing the legs to be releasably engageable with the legs-retaining members and optionally, for providing the legs to be adjusted relative to the contour of the waterbed. For example, the length of the legs, the length of the connecting assembly (for instance the length of the web-supporting transversal member thereof and the height of the extension posts thereof), can be variable.

According to its configuration, the cofferdam system described above, which includes a plurality of frame-supporting structures and at least one connecting assembly as represented in any one of FIGS. 1 to 12, allows to securely, easily and quickly provide a substantially dry environment or enclosure working area. Such dry working environment can be provided even if the waterway or watercourse bed is found to be uneven. Furthermore, the cofferdam system can be dismantled, and re-used for providing a different dry working environment. Finally, thanks to the sizes, shapes and configurations of its components, the cofferdam system can be easily and properly stored and/or transported/shipped from one site to another (e.g., the components can be stacked one over another so it can reduce the storage space needed).

The cofferdam web-supporting frame assemblies described above can thus be re-usable, portable and can easily be used to assemble and disassemble the overall cofferdam system. The components can be easily transported on site as lighter than conventional frames and can be stacked during transport and storage. The longitudinally extending frame-supporting legs can also optimally be adjusted, if the waterway or watercourse bed is uneven. The cofferdam system can be used to contain a building or structure for repairing or restoring the same or can be used as a flood barrier to protect a house, building or community. The dam can thus also be used to handle all kinds of floods in all kinds of terrains.

Figure 13:
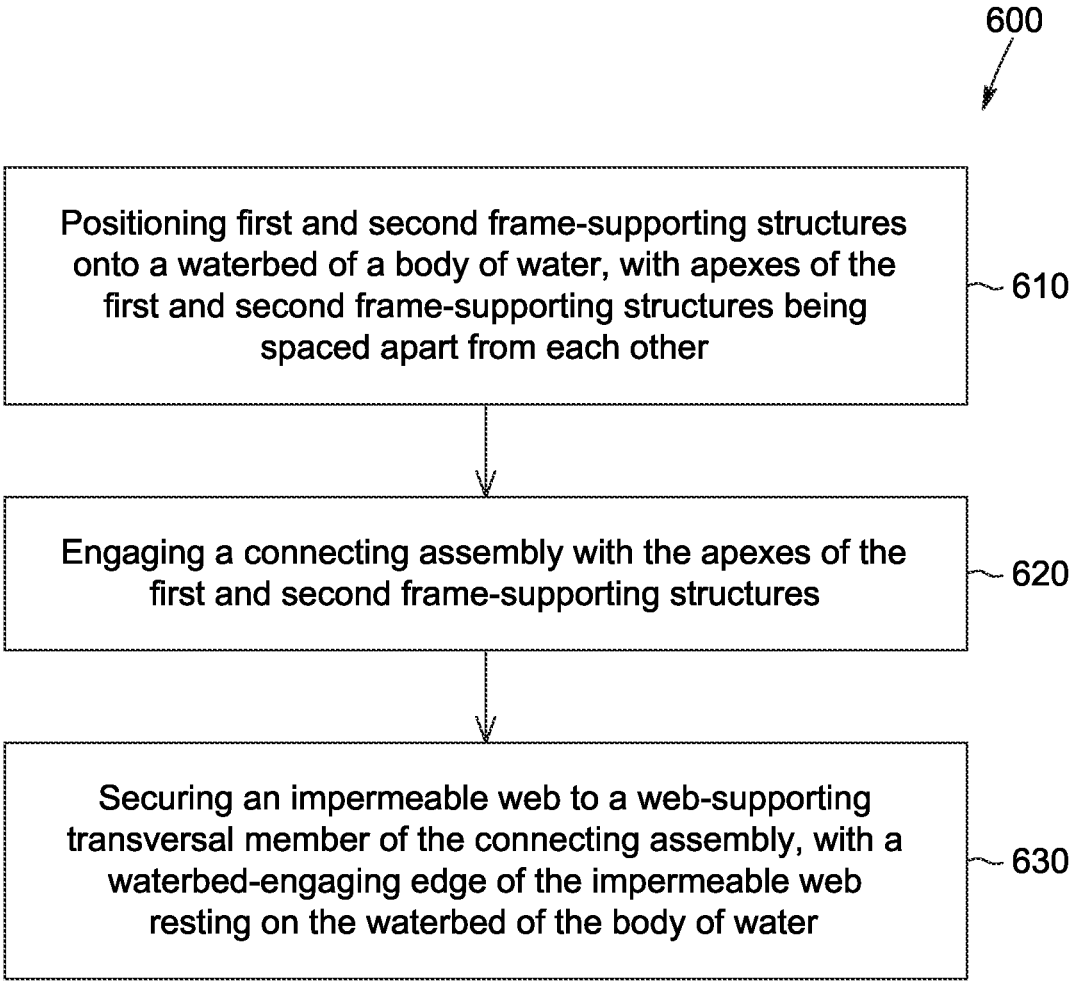
FIG. 13 is a block diagram representing the different steps of a method for at least partially delimiting a pumpable enclosure within a body of water in accordance with an embodiment.

According to another aspect, as represented in FIG. 13, there is disclosed a method 600 for at least partially delimiting an enclosure within a body of water. For instance, the method is carried out with a cofferdam system comprising a plurality of cofferdam web-supporting frame assemblies 10, 110, 210, 310, 410 as the ones disclosed above.

In the embodiment shown, the method 600 comprises a step 610 of positioning at least first and second frame-supporting structures onto a waterbed of the body of water, with apexes of the first and second frame-supporting structures being spaced apart from each other; a step 620 of engaging a connecting assembly with the apexes of the first and second frame-supporting structures; and a step 630 of securing an impermeable web to a web-supporting transversal member of the connecting assembly, with a waterbed-engaging edge of the impermeable web resting on the waterbed of the body of water.

Although the present invention has been described hereinabove by way of specific embodiments thereof, it can be modified, without departing from the spirit and nature of the subject invention defined in the appended claims.

The invention claimed is:

1. A deployable cofferdam web-supporting frame assembly for a cofferdam system configured to be installed within a body of water to at least partially delimit therein an enclosure, the deployable cofferdam web-supporting frame assembly comprising:

a first frame-supporting structure comprising a first apex and a first group of longitudinally extending frame-supporting legs, each frame-supporting leg of the first group having a waterbed-engaging end, the first frame-supporting structure being configurable into a usage configuration wherein the frame-supporting legs of the first group are connected to each other with the waterbed-engaging ends thereof being spaced apart from one another, and a storage configuration wherein the frame-supporting legs of the first group are substantially parallel to each other;

a second frame-supporting structure comprising a second apex and a second group of longitudinally extending frame-supporting legs, each frame-supporting leg of the second group having a waterbed-engaging end, the second frame-supporting structure being configurable into a usage configuration wherein the frame-supporting legs of the second group are connected to each other with the waterbed-engaging ends thereof being spaced apart from one another, and a storage configuration wherein the frame-supporting legs of the second group are substantially parallel to each other; and a connecting assembly releasably securable to the first and second frame-supporting structures to connect the first and second apexes to each other;

wherein the first and second frame-supporting structures comprise respectively first and second legs-retaining members comprising respectively the first and second apexes, the first and second groups of frame-supporting legs being removably mounted respectively to the first and second legs-retaining members; and wherein each of the first and second legs-retaining members comprises a legs-connecting body at least partially delimiting a post-receiving channel, the connecting assembly being engaged with the post-receiving channels of the first and second legs-retaining members.

2. The frame assembly according to claim 1, wherein at least one of the first and second frame-supporting structures forms a substantially triangular-based pyramid when the corresponding frame-supporting legs are in the usage configuration.

3. The frame assembly according to claim 1, wherein each of the first and second legs-retaining members further comprises a plurality of leg-receiving sleeves mounted to or formed integral with an outer surface of the corresponding legs-connecting body, the frame-supporting legs being removably engaged with the corresponding leg-receiving sleeves.

4. The frame assembly according to claim 3, wherein at least one of the frame-supporting legs is slidably mounted to the corresponding leg-receiving sleeve, a distance between the corresponding one of the first and second legs-retaining members and the waterbed-engaging end of said at least one of the frame-supporting legs being adjustable.

5. The frame assembly according to claim 1, wherein the connecting assembly comprises a web-supporting transversal member having opposed first and second longitudinal end portions, and first and second extension posts removably mounted respectively to the first and second apexes and mounted respectively to the first and second longitudinal end portions of the web-supporting transversal member.

6. The frame assembly according to claim 5, wherein each of the first and second extension posts comprises a waterbed-engaging end and is slidably mounted to the corresponding legs-connecting body.

7. A modular cofferdam web-supporting frame assembly for a cofferdam system configured to be installed within a body of water to at least partially delimit therein an enclosure, the modular cofferdam web-supporting frame assembly comprising:

a first frame-supporting structure comprising:

a first legs-retaining member; and a first group of longitudinally extending frame-supporting legs, each one of the frame-supporting legs being engaged with the first legs-retaining member and having a waterbed-engaging end, the waterbed-engaging ends of the first group of frame-supporting legs being spaced apart from one another;

a second frame-supporting structure comprising:

a second legs-retaining member spaced-apart from the first legs-retaining member;

a second group of longitudinally extending frame-supporting legs, each one of the frame-supporting legs being engaged with the second legs-retaining member and having a waterbed-engaging end, the waterbed-engaging ends of the second group of frame-supporting legs being spaced apart from one another; and a connecting assembly connecting the first and second legs-retaining members to each other;

wherein the connecting assembly comprises a web-supporting transversal member having opposed first and second longitudinal end portions, and first and second extension posts removably mounted respectively to the first and second legs-retaining members and mounted respectively to the first and second longitudinal end portions of the web-supporting transversal member.

8. The frame assembly according to claim 7, wherein each of the first and second extension posts comprises a waterbed-engaging end and is slidably mounted to the corresponding legs-retaining member.

9. The frame assembly according to claim 7, wherein the connecting assembly is releasably secured to the first and second legs-retaining members, and wherein the first and second groups of frame-supporting legs are removably mounted respectively to the first and second legs-retaining members.

10. The frame assembly according to claim 7, wherein each of the first and second legs-retaining members comprises a legs-connecting body at least partially delimiting a post-receiving channel, the connecting assembly being engaged with the post-receiving channels of the first and second legs-retaining members.

11. The frame assembly according to claim 10, wherein each of the first and second legs-retaining members further comprises a plurality of leg-receiving sleeves mounted to or formed integral with an outer surface of the corresponding legs-connecting body, the frame-supporting legs being removably engaged with the corresponding leg-receiving sleeves.

12. The frame assembly according to claim 11, wherein at least one of the frame-supporting legs is slidably mounted to the corresponding leg-receiving sleeve, a distance between the corresponding one of the first and second legs-retaining members and the waterbed-engaging end of said at least one of the frame-supporting legs being adjustable.

13. The frame assembly according to claim 7, wherein at least one of the first and second frame-supporting structures forms a substantially triangular-based pyramid.

14. A cofferdam system comprising:

a cofferdam web-supporting frame assembly according to claim 7; and a substantially flexible impermeable web secured to the cofferdam web-supporting frame assembly, the substantially flexible impermeable web covering at least partially a water-facing side of the cofferdam web-supporting frame assembly.

15. A modular cofferdam web-supporting frame assembly for a cofferdam system configured to be installed within a body of water to at least partially delimit therein an enclosure, the modular cofferdam web-supporting frame assembly comprising:

a first frame-supporting structure comprising:

a first legs-retaining member; and a first group of longitudinally extending frame-supporting legs, each one of the frame-supporting legs being engaged with the first legs-retaining member and having a waterbed-engaging end, the waterbed-engaging ends of the first group of frame-supporting legs being spaced apart from one another;

a second frame-supporting structure comprising:

a second legs-retaining member spaced-apart from the first legs-retaining member;

a second group of longitudinally extending frame-supporting legs, each one of the frame-supporting legs being engaged with the second legs-retaining member and having a waterbed-engaging end, the waterbed-engaging ends of the second group of frame-supporting legs being spaced apart from one another; and a connecting assembly connecting the first and second legs-retaining members to each other;

wherein the connecting assembly is releasably secured to the first and second legs-retaining members, and wherein the first and second groups of frame-supporting legs are removably mounted respectively to the first and second legs-retaining members.

16. The frame assembly according to claim 15, wherein each of the first and second legs-retaining members comprises a legs-connecting body at least partially delimiting a post-receiving channel, the connecting assembly being engaged with the post-receiving channels of the first and second legs-retaining members.

17. The frame assembly according to claim 16, wherein each of the first and second legs-retaining members further comprises a plurality of leg-receiving sleeves mounted to or formed integral with an outer surface of the corresponding legs-connecting body, the frame-supporting legs being removably engaged with the corresponding leg-receiving sleeves.

18. The frame assembly according to claim 17, wherein at least one of the frame-supporting legs is slidably mounted to the corresponding leg-receiving sleeve, a distance between the corresponding one of the first and second legs-retaining members and the waterbed-engaging end of said at least one of the frame-supporting legs being adjustable.

19. The frame assembly according to claim 15, wherein at least one of the first and second frame-supporting structures forms a substantially triangular-based pyramid.

20. A cofferdam system comprising:

a cofferdam web-supporting frame assembly according to claim 15; and a substantially flexible impermeable web secured to the cofferdam web-supporting frame assembly, the substantially flexible impermeable web covering at least partially a water-facing side of the cofferdam web-supporting frame assembly.

* * * * *